US009115606B2

(12) United States Patent
Vaseleniuck et al.

(10) Patent No.: US 9,115,606 B2
(45) Date of Patent: Aug. 25, 2015

(54) HEAD ASSEMBLY FOR AN INTERNAL COMBUSTION ENGINE

(71) Applicant: VAZTEC, LLC, Denver, NC (US)

(72) Inventors: Darrick Vaseleniuck, Denver, NC (US); David Vaseleniuck, Denver, NC (US)

(73) Assignee: VAZTEC, LLC, Denver, NC (US)

( * ) Notice: Subject to any disclaimer, the term of this patent is extended or adjusted under 35 U.S.C. 154(b) by 0 days.

(21) Appl. No.: 13/647,921

(22) Filed: Oct. 9, 2012

(65) Prior Publication Data

US 2013/0087117 A1 Apr. 11, 2013

Related U.S. Application Data

(60) Provisional application No. 61/545,342, filed on Oct. 10, 2011.

(51) Int. Cl.

| | |
|---|---|
| ***F02B 75/32*** | (2006.01) |
| ***F01L 7/02*** | (2006.01) |
| ***F01L 7/16*** | (2006.01) |

(52) U.S. Cl.

CPC .. *F01L 7/026* (2013.01); *F01L 7/16* (2013.01)

(58) Field of Classification Search

CPC ..... F02B 1/04; F02B 75/24; F02B 75/32; F02F 1/22; F02F 1/4235; F02M 25/0713; F02D 13/0203; F01N 3/30; F01N 3/34

USPC ..... 123/197.4, 197.1, 193.1, 193.5, 193.3, 123/193.4, 190.1, 41.4, 56.1, 56.2, 54.3, 123/59.1, 80 BB

See application file for complete search history.

(56) References Cited

U.S. PATENT DOCUMENTS

| | | | | |
|---|---|---|---|---|
| 1,094,329 | A * | 4/1914 | Henderson | 123/80 BA |
| 1,794,061 | A * | 2/1931 | Culver | 123/190.2 |
| 4,036,184 | A | 7/1977 | Guenther | |
| 6,295,961 | B1 * | 10/2001 | Carter | 123/190.1 |
| 6,308,677 | B1 | 10/2001 | Bohach | |
| 7,240,654 | B2 * | 7/2007 | Verdial | 123/190.4 |
| 2002/0148428 | A1 * | 10/2002 | Pisano et al. | 123/190.2 |
| 2006/0150930 | A1 * | 7/2006 | Swenson | 123/59.1 |
| 2011/0277719 | A1 * | 11/2011 | Snow | 123/190.4 |

FOREIGN PATENT DOCUMENTS

| | | |
|---|---|---|
| EP | 0099873 | 2/1984 |

OTHER PUBLICATIONS

Machine Translation of EP0099873A2, see (EP0099873A2_ MachineTranslation.pdf).*

Vorobiev, V., International Search Report for PCT/US2012/059506, Dec. 24, 2012, Moscow, Russia.

* cited by examiner

*Primary Examiner* — Lindsay Low
*Assistant Examiner* — Long T Tran
(74) *Attorney, Agent, or Firm* — Trego, Hines & Ladenheim, PLLC

(57) ABSTRACT

A head assembly and valve-less internal combustion engine are disclosed. The head assembly includes a head having a first port extending through the head and a surface defining a portion of a combustion chamber in fluid communication with the first port. The head further includes a first shaft mounted in a first bore of the head between the first port and the combustion chamber. The first shaft includes a first aperture extending therethrough and is rotatable between a first orientation wherein the first shaft blocks fluid communication between the first port and the combustion chamber and a second orientation wherein the first shaft permits fluid communication between the first port and the combustion chamber through the first aperture.

4 Claims, 9 Drawing Sheets

HEAD ASSEMBLY FOR AN INTERNAL COMBUSTION ENGINE

BACKGROUND OF THE INVENTION

The present invention relates to internal combustion engines, and more particularly, the invention relates to a head assembly and valve-less internal combustion engine.

Internal combustion engines are well known and are used in various applications. For example, internal combustion engines are used in automobiles, farm equipment, lawn mowers, and watercraft. Internal combustion engines also come in various sizes and configurations, such as two stroke or four stroke and ignition or compression.

Typically, internal combustion engines (FIG. 1) include a multitude of moving parts, for example, they include intake and exhaust valves, rocker arms, springs, camshafts, connecting rods, pistons, and a crankshaft. One of the problems with having a multitude of moving parts is that the risk of failure increases (particularly in the valve train) and efficiency decreases due to frictional losses. Special lubricants and coatings may be used to reduce friction and certain alloys may be used to prevent failure; however, even with these enhancements, the risk of failure and the frictional losses remain high.

BRIEF SUMMARY OF THE INVENTION

These and other shortcomings of the prior art are addressed by the present invention, which provides a valve-less internal combustion engine that increases reliability and increases efficiency.

According to one aspect of the invention, a head assembly for a valve-less internal combustion engine includes a head having a first port extending through the head and a surface defining a portion of a combustion chamber in fluid communication with the first port. The head further includes a first shaft mounted in a first bore of the head between the first port and the combustion chamber. The first shaft includes a first aperture extending therethrough and is rotatable between a first orientation wherein the first shaft blocks fluid communication between the first port and the combustion chamber and a second orientation wherein the first shaft permits fluid communication between the first port and the combustion chamber through the first aperture.

According to another aspect of the invention, a head assembly for a valve-less internal combustion engine includes a head and a first shaft mounted in a first bore of the head. The head includes a surface defining a portion of a combustion chamber, an intake port extending through the head and in fluid communication with the combustion chamber for directing combustion air into the combustion chamber, and an exhaust port extending through the head and in fluid communication with the combustion chamber for directing exhaust gas out of the combustion chamber. The first shaft is mounted between the combustion chamber and a selected one of the intake and exhaust ports. The first shaft includes a first aperture extending therethrough and is rotatable between a first orientation wherein the first shaft blocks fluid communication between the combustion chamber and the selected one of the intake and exhaust ports and a second orientation wherein the first shaft permits fluid communication between the combustion chamber and the selected one of the intake and exhaust ports through the first aperture.

According to another aspect of the invention, a valve-less internal combustion engine includes an engine block containing a rotating assembly and a head assembly. The rotating assembly includes a crankshaft positioned for rotation in the engine block, a piston adapted for linear movement in a cylinder between a first, non-compression position and a second, compression position, and a connecting rod for interconnecting the crankshaft and the piston such that rotation of the crankshaft causes the connecting rod to move the piston between the first and second positions. The head assembly includes a head having a first port extending through the head and in fluid communication with a combustion chamber defined by the cylinder and the head collectively. The head assembly further includes a first shaft mounted in a first bore of the head between the first port and the combustion chamber. The first shaft includes a first aperture extending therethrough and is rotatable between a first orientation wherein the first shaft blocks fluid communication between the first port and the combustion chamber and a second orientation wherein the first shaft permits fluid communication between the first port and the combustion chamber through the first aperture.

BRIEF DESCRIPTION OF THE DRAWINGS

The subject matter that is regarded as the invention may be best understood by reference to the following description taken in conjunction with the accompanying drawing figures in which.

DETAILED DESCRIPTION OF THE INVENTION

Figure 1:
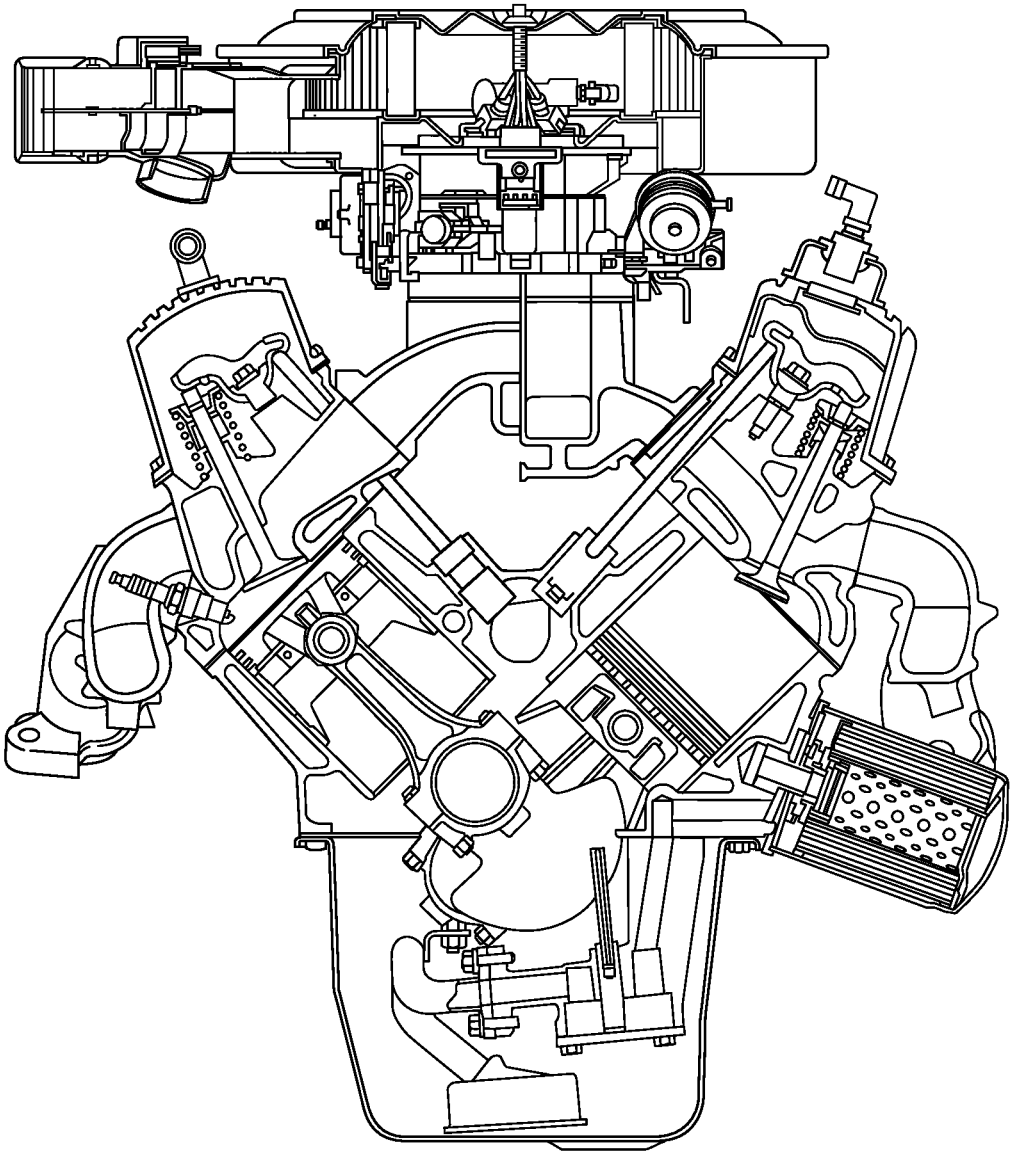
FIG. 1 (PRIOR ART)
FIG. 1 shows a prior art V-8 internal combustion engine.
Figure 2:
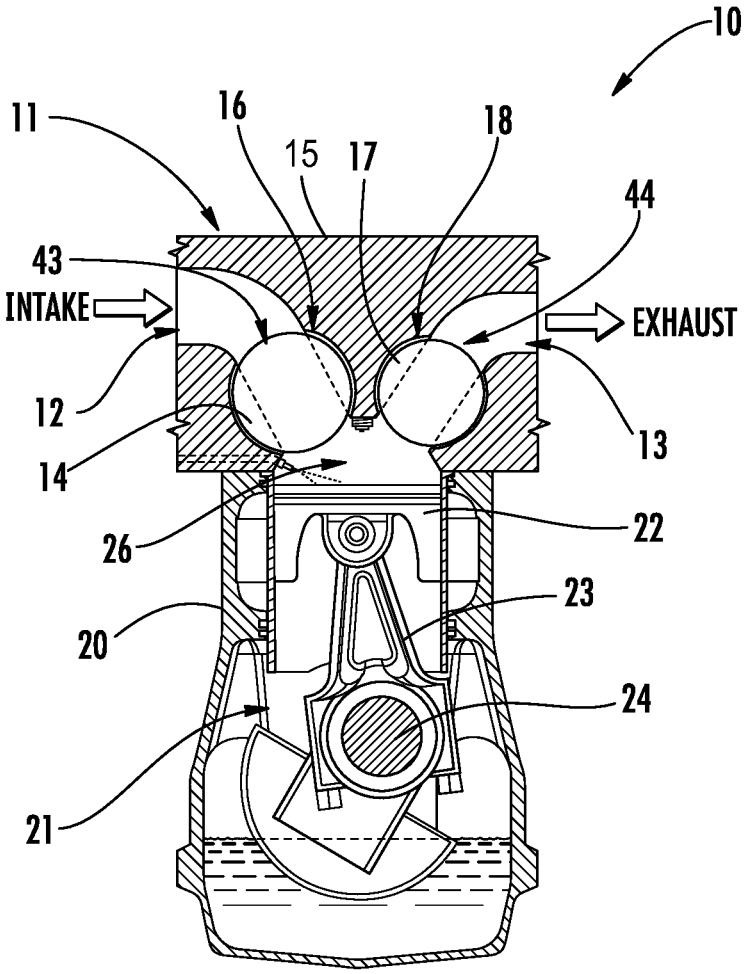
FIG. 2 shows an internal combustion engine according to an embodiment of the invention.

Referring to the drawings, an exemplary valve-less internal combustion (IC) engine according to an embodiment is shown generally at reference numeral 10. The engine 10 includes a head assembly 11 having head 15 with at least one intake port 12, at least one exhaust port 13, a rotatable intake shaft 14 secured in a first bore 16 of the head 15, and a rotatable exhaust shaft 17 secured in a second bore 18 of the head assembly 15. The head assembly 11 may be part of or mounted on a standard engine block 20 having a rotating assembly 21 (piston 22, connecting rod 23, and crankshaft 24) contained therein. As shown, the rotating intake shaft 14 and rotating exhaust shaft 17 are positioned between the at least one intake port 12 and at least one exhaust port 13, respectively, and a combustion chamber 26. It should be appreciated that at least a portion of the combustion chamber 26 is defined by a surface of the head It should be appreciated that the number of head assemblies 11 on an engine will depend on the number of cylinders the engine has. A single cylinder engine is simply being used for discussion purposes. It should also be appreciated that the head assembly may be a single head design or of a two-part head design.

Figure 3:
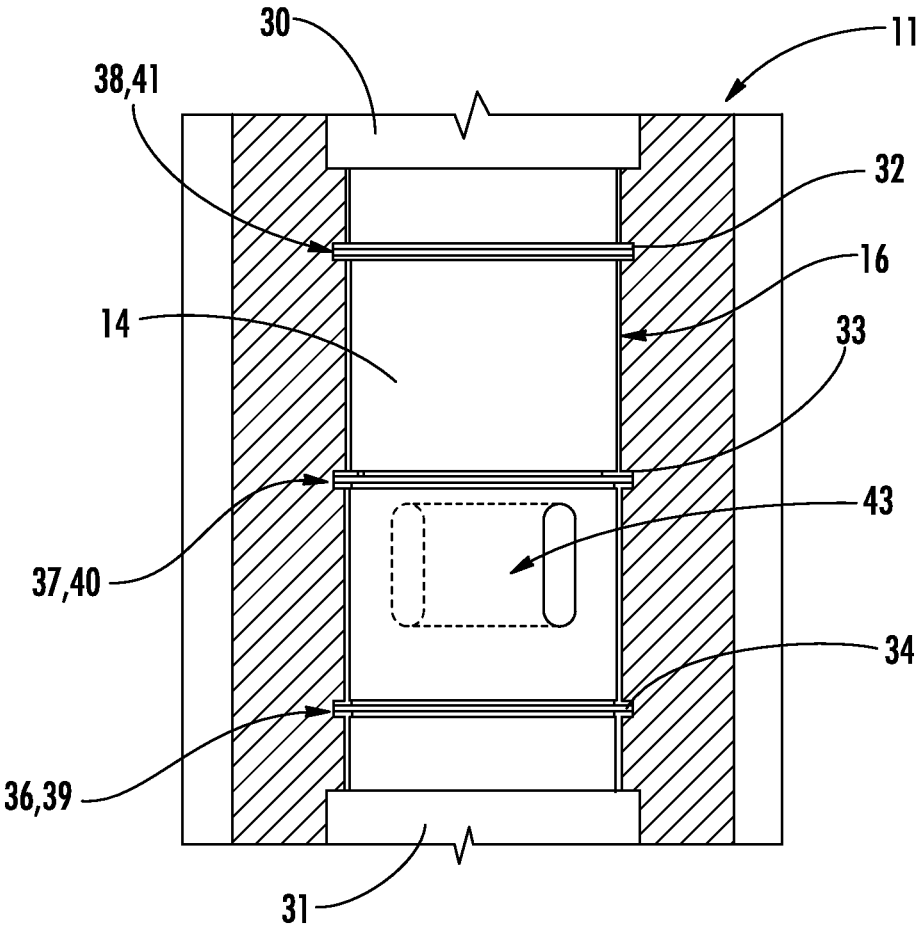
FIG. 3 shows a head assembly of the internal combustion engine of FIG. 2.

For purposes of the following discussion, since the intake and exhaust shaft assemblies are the same, only the intake shaft 14 will be discussed. As illustrated in FIG. 3, the intake shaft 14 resides in the first bore 16 of the head 15 and is rotatably mounted in the bore 16 by bearings 30 and 31. Seals 32-34 are positioned within grooves 36-38 of the bore 16 and grooves 39-41 of the intake shaft 14 to prevent gas leakage. The intake shaft 14 has a pre-determined diameter and includes an aperture 43 having a pre-determined diameter that extends through the shaft 14 to allow intake air to move through the intake port 12, through the aperture 43, and into the combustion chamber 26. It should be appreciated that the shaft 14 may have multiple smaller apertures or a single large aperture, as shown. It should also be appreciated that the size of the aperture 43 is dependent on the shaft diameter and the desired timing. By changing the diameter of the aperture 43, the timing of the engine may be changed.

Figures 4A, 4B, 4C, 4D:
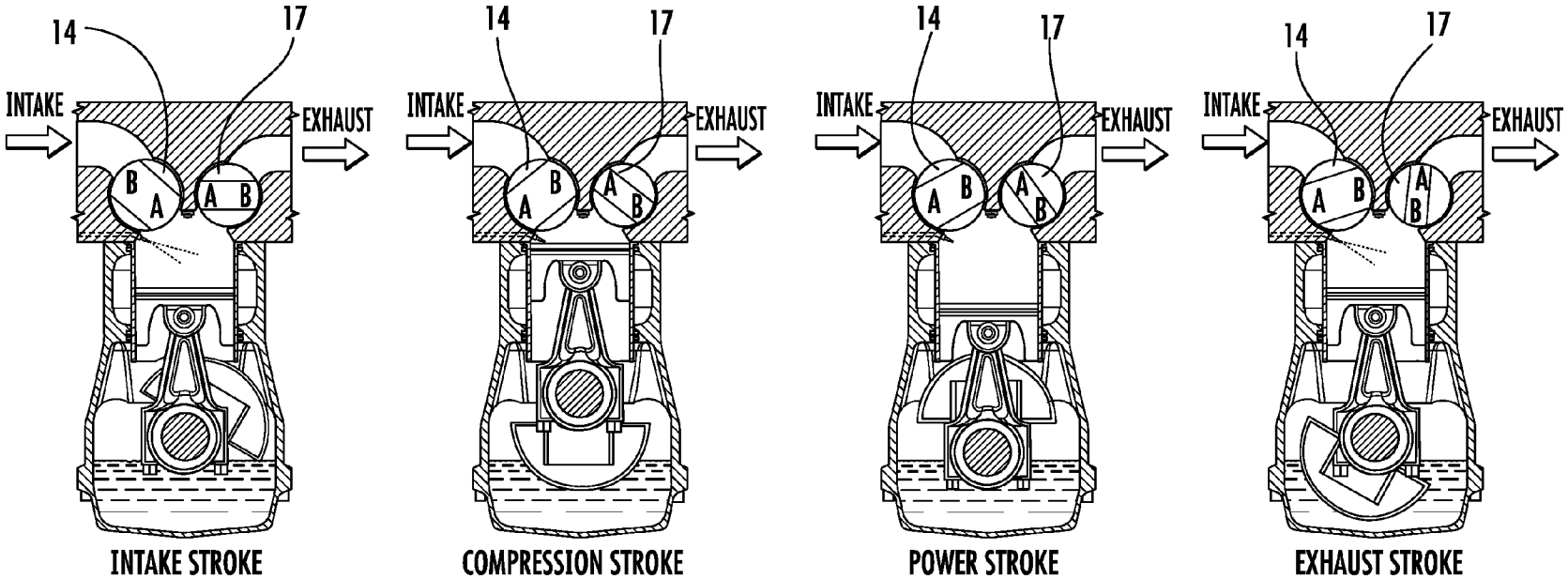
FIGS. 4A-4D show the four strokes of the internal combustion engine of FIG. 2.

Referring to FIG. 4, the intake shaft 14 and exhaust shaft 17 are driven by a belt or chain (not shown) attached to the crankshaft 24 and rotate at a 4 to 1 ratio relative to the crankshaft 24. During the four strokes of an engine, the intake shaft 14 and exhaust shaft 17 constantly rotate to position their apertures in the proper position relative to the ports 12, 13. The "A" and "B" notations in the apertures 43 and 44 are used to show the rotation of the shafts 14 and 17 relative to the strokes. As shown, during the intake stroke, the aperture 43 of the intake shaft 14 is substantially aligned with the intake port 12 to allow air into the combustion chamber 26. Aperture 44 of the exhaust shaft 17 is positioned such that exhaust shaft 17 closes the exhaust port 13 and air or gas is prevented from escaping the combustion chamber 26 through the exhaust port 13. During the compression stroke, the apertures 43 and 44 of the intake and exhaust shafts 14 and 17 are both rotated to close off the intake port 12 and exhaust port 13. During the power stroke, the apertures 43 and 44 of the intake and exhaust shafts 14 and 17 continue to keep the intake and exhaust ports 12, 13 closed. Finally, during the exhaust stroke, the intake shaft 14 continues to close the port 12 and exhaust shaft 17 is positioned such that the exhaust port 13 is now opened by substantially aligning the aperture 44 with the exhaust port 13. The process then repeats. During this process, an overlapping occurs, i.e., as the exhaust port begins to close, the intake begins to open to complete the overlap which begins the charge (air runs into the combustion chamber). It should be appreciated that in a dual shaft system like being described, the separation of the apertures 43 and 44 may be adjusted to change the timing of the engine.

Figure 5:
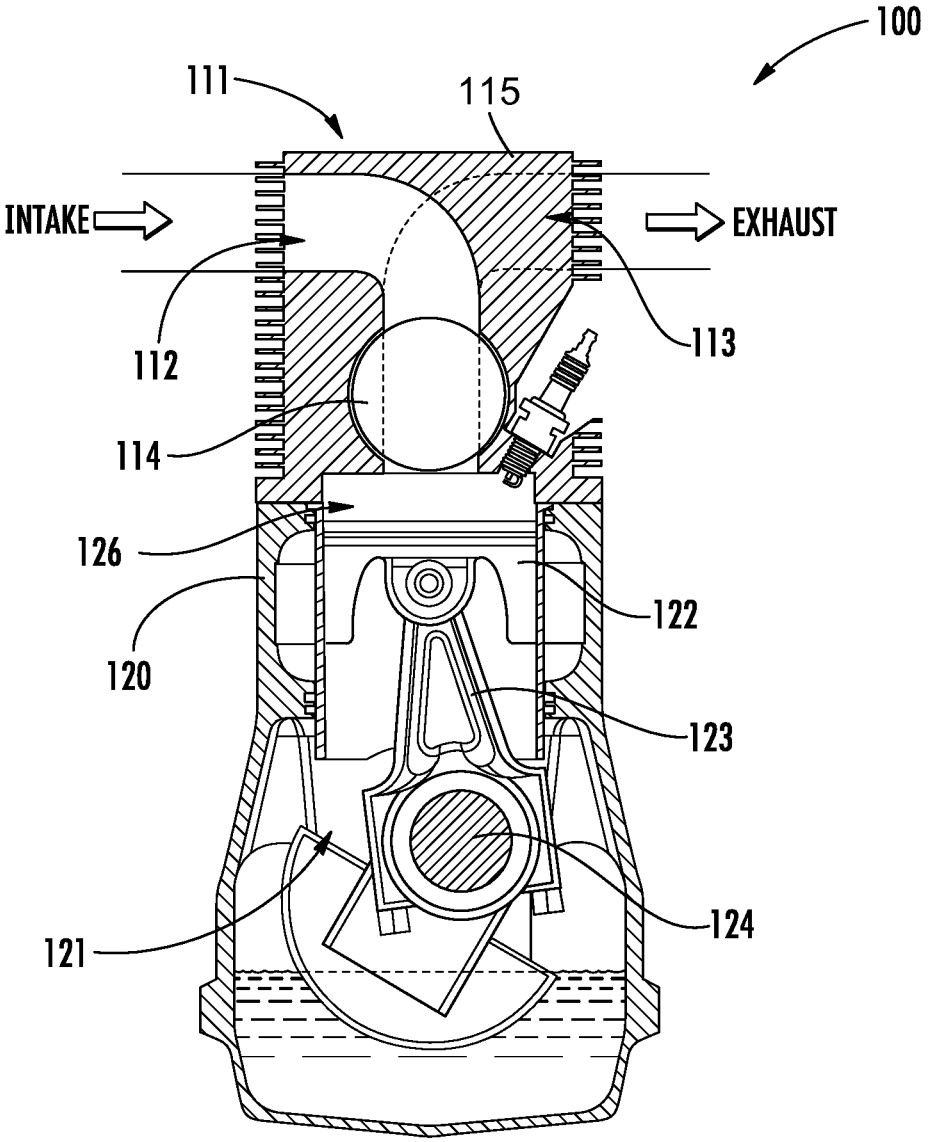
FIG. 5 shows an internal combustion engine according to an embodiment of the invention.

Referring now to FIG. 5, a valve-less internal combustion (IC) engine according to an embodiment is shown generally at reference numeral 100. Like engine 10, engine 100 includes a head assembly 111 having a head 115 with an intake port 112 and an exhaust port 113. The head assembly 111 may be part of or mounted to a standard engine block 120 having a rotating assembly assembly 121 (piston 122, connecting rod 123, and crankshaft 124) contained therein. The main difference between the engine 10 and 100 is that the engine 100 uses a single rotating shaft 114 to perform both intake and exhaust processes.

Figure 6:
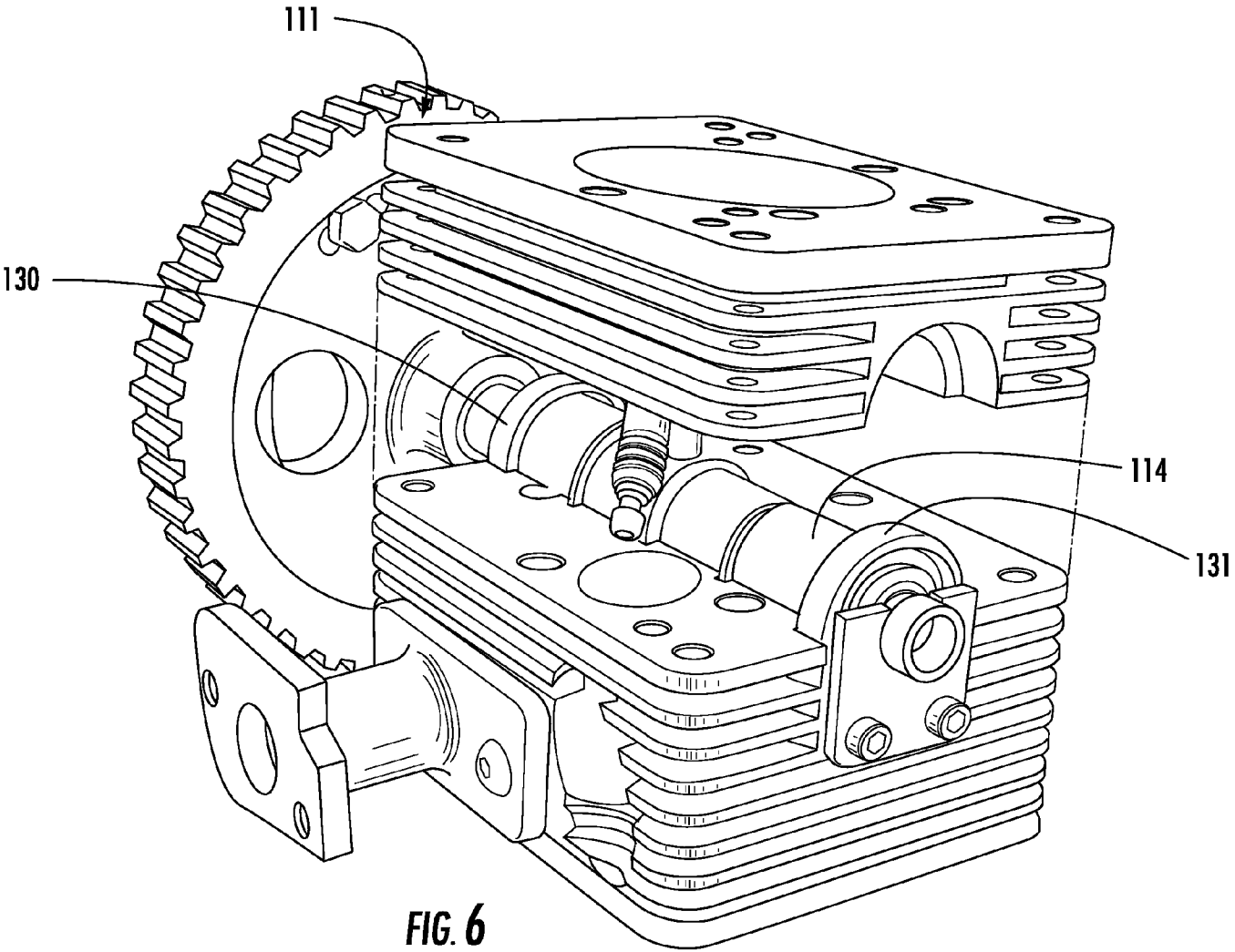
FIGS. 6-7 show a head assembly of the internal combustion engine of FIG. 5.
Figure 7:
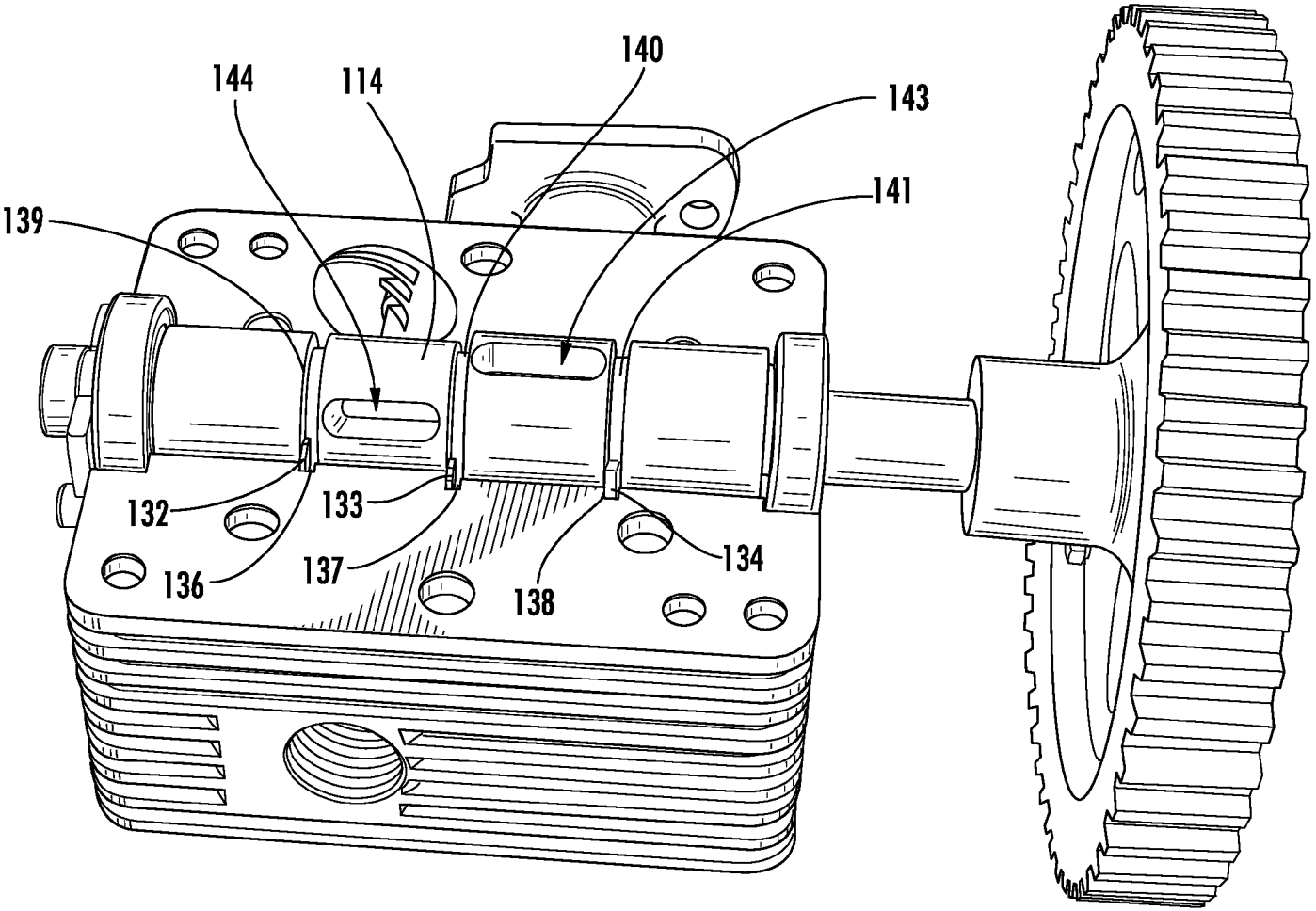
Figure 8:
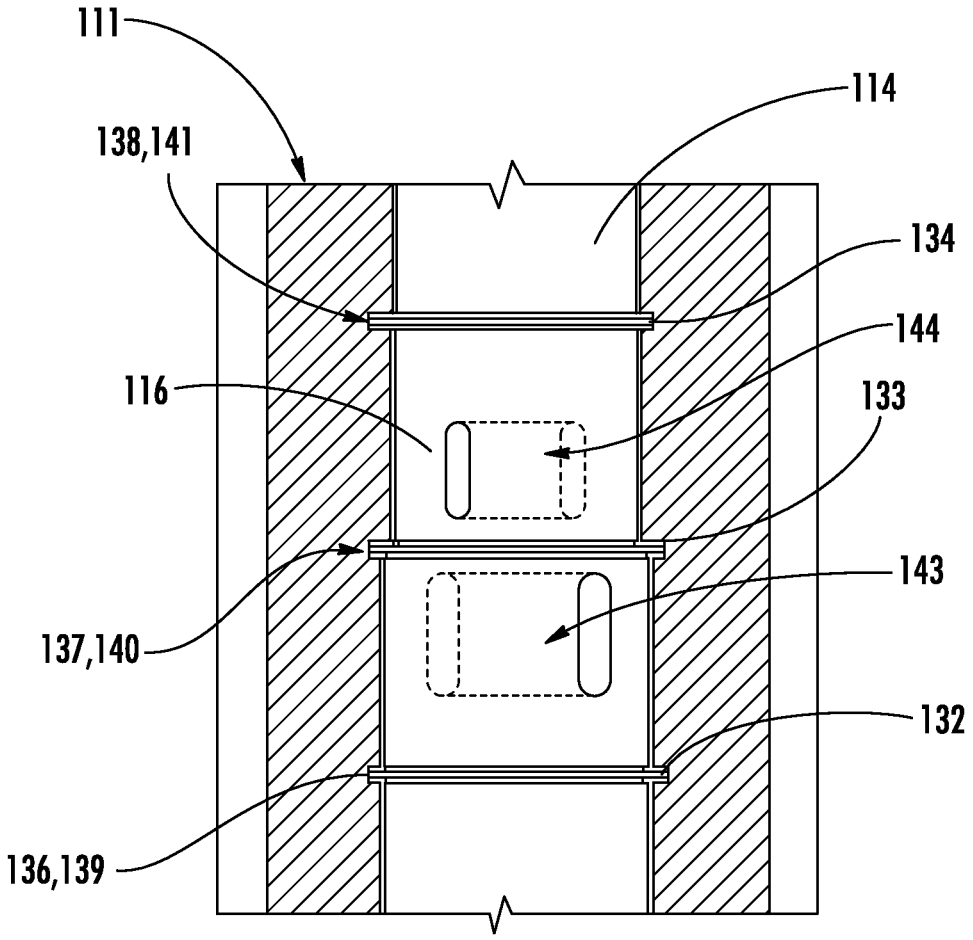
FIG. 8 shows an intake and exhaust shaft of the internal combustion engine of FIG. 5.

Referring to FIGS. 6-8, as discussed above with respect to head assembly 11, the rotating shaft 114 resides in a bore 116 of the head 115 and is rotatably mounted in the bore 116 by bearings 130 and 131. Seals 132-134 are positioned within grooves 136-138 of the bore 116 and grooves 139-141 of the shaft 114 to prevent gas leakage. The shaft 114 has a pre-determined stepped diameter design and includes an intake aperture 143 having a pre-determined diameter and an exhaust aperture 144 having a pre-determined diameter. The intake aperture 143 extends through the shaft 114 to allow intake air to move through the intake port 112, through the aperture 143, and into combustion chamber 126. The exhaust aperture 144 is positioned on a smaller diameter section of the shaft 114 and at a pre-determined angle relative to the intake aperture 143 to provide a separation therebetween. The exhaust aperture 144 extends through the shaft 114 to allow exhaust air or gas to move out of the combustion chamber 126, through the exhaust aperture 144, and out the exhaust port 113. It should be appreciated that the shaft 114 may have multiple smaller apertures or a single large aperture, as shown, for each of the intake and exhaust apertures 143, 144. It should also be appreciated that the size of the apertures 143 and 144 are dependent on the shaft diameter and the desired timing. By changing the diameter of the apertures 143 and 144, the timing of the engine may be changed. It should be appreciated that the shaft 114 may be driven by a belt or chain via the crankshaft as described above with respect to engine 10.

Figures 9A, 9B, 9C, 9D:
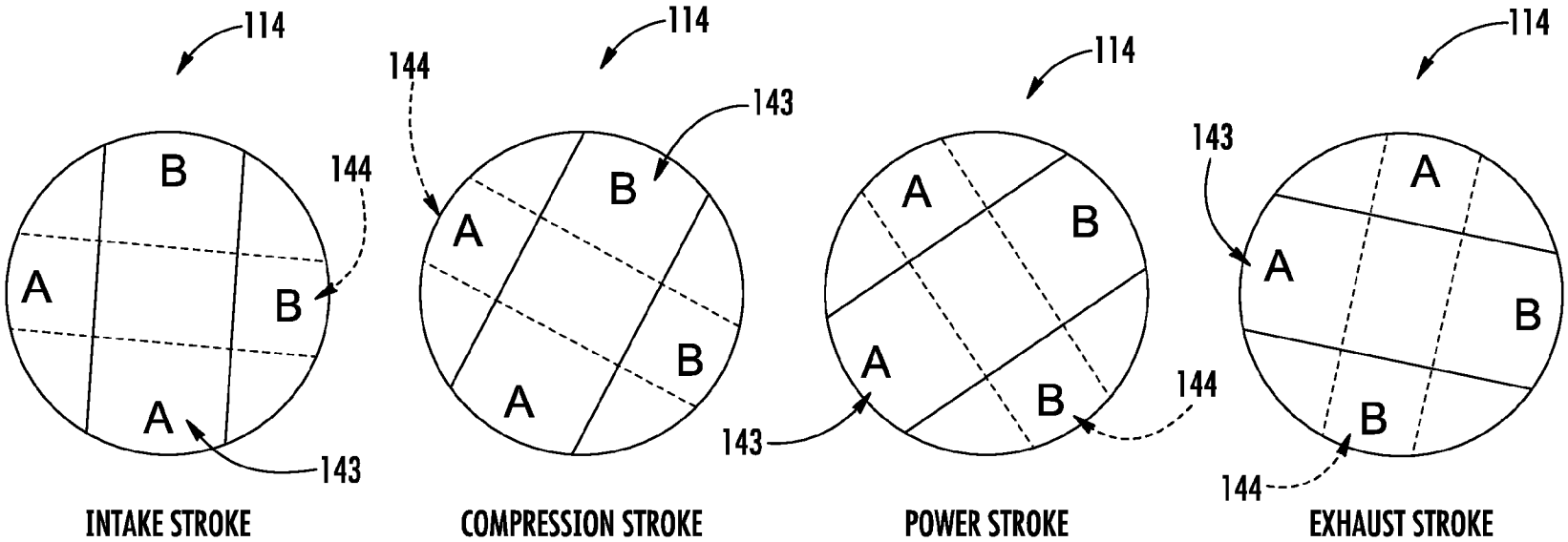
FIGS. 9A-9D show the four strokes of the internal combustion engine of FIG. 5.

As illustrated in FIG. 9, the intake and exhaust apertures 143 and 144 are separated to allow a four stroke engine to function properly. During the four strokes of the engine 100, the shaft 114 constantly rotates to position the apertures 143, 144 in the proper position relative to the ports 112, 113. As shown, during the intake stroke, the aperture 143 is substantially aligned with the intake port 112 to allow air into the combustion chamber 126. Aperture 144 is positioned such that shaft 114 closes the exhaust port 113 and air or gas is prevented from escaping the combustion chamber 126 through the exhaust port 113. During the compression stroke, the apertures 143 and 144 are both rotated to close off the intake port 112 and exhaust port 113. During the power stroke, the apertures 143 and 144 continue to keep the intake and exhaust ports 112, 113 closed. Finally, during the exhaust stroke, the shaft 114 continues to close the port 112 and aperture 144 substantially aligns with the port 113 to open the exhaust port 113 and allow gas to escape the combustion chamber 126. The process then repeats. During this process, an overlapping occurs, i.e., as the exhaust port begins to close, the intake begins to open to complete the overlap which begins the charge (air runs into the combustion chamber).

The foregoing has described a valve-less internal combustion engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

We claim:

1. A head assembly for an internal combustion engine, comprising:

(a) a head including:

(i) surfaces defining portions of a plurality of combustion chambers;

(ii) a plurality of intake ports, each intake port extending through the head and in fluid communication with one of the combustion chambers for directing combustion air into the respective combustion chamber;

(iii) a plurality of exhaust ports, each exhaust port extending through the head and in fluid communication with one of the combustion chambers for directing exhaust gas out of the respective combustion chamber;

(b) a first shaft having a first diameter mounted in a first bore of the head between the combustion chambers and the intake ports, wherein the first shaft includes a plurality of first apertures extending completely through the first shaft perpendicularly to a length of the first shaft across the first diameter, the plurality of first apertures being positioned along a length of the first shaft in a spaced-apart, offset relation, wherein for each one of the combustion chambers, the first shaft is rotatable between a first orientation wherein the first shaft blocks fluid communication between the combustion chamber and the respective intake port and a second orientation wherein the first shaft permits fluid communication between the combustion chamber and the intake port through one of the first apertures; and (c) a second shaft having a second diameter different from the first diameter mounted in a second bore of the head between the exhaust ports and the combustion chambers, wherein the second shaft includes a plurality of second apertures extending completely through the second shaft perpendicularly to a length of the second shaft across the second diameter, the plurality of second apertures being positioned along a length of the second shaft in a spaced-apart, offset relation, wherein for each one of the combustion chambers, the second shaft is rotatable between a first orientation wherein the second shaft blocks fluid communication between the combustion chamber and the respective exhaust port and a second orientation wherein the second shaft permits fluid communication between the combustion chamber and the exhaust port through one of the second apertures.

2. An internal combustion engine, comprising:

(a) an engine block containing a rotating assembly, the rotating assembly having:

(i) a crankshaft positioned for rotation in the engine block;

(ii) a plurality of pistons adapted for linear movement in a plurality of cylinders between a first, non-compression position and a second, compression position; and (iii) a connecting rod interconnecting the crankshaft with each of and the pistons such that rotation of the crankshaft causes the connecting rods to move the respective piston between the first and second positions;

(b) a head assembly having:

(i) a head including:

(A) surfaces which, collectively with the cylinders, define a plurality of combustion chambers;

(B) a plurality of intake ports, each intake port extending through the head and in fluid communication with one of the combustion chambers for directing combustion air into the respective combustion chamber;

(C) a plurality of exhaust ports, each exhaust port extending through the head and in fluid communication with one of the combustion chambers for directing exhaust gas out of the respective combustion chamber;

(ii) a first shaft having a first diameter mounted in a first bore of the head between the combustion chambers and the intake ports, wherein the first shaft includes a plurality of first apertures extending completely through the first shaft perpendicularly to a length of the first shaft across the first diameter, the plurality of first apertures being positioned along a length of the first shaft in a spaced-apart, offset relation, wherein for each one of the combustion chambers, the first shaft is rotatable between a first orientation wherein the first shaft blocks fluid communication between the combustion chamber and the respective intake port and a second orientation wherein the first shaft permits fluid communication between the combustion chamber and the intake port through one of the first apertures; and (iii) a second shaft having a second diameter different from the first diameter mounted in a second bore of the head between the exhaust ports and the combustion chambers, wherein the second shaft includes a plurality of second apertures extending completely through the second shaft perpendicularly to a length of the second shaft across the second diameter, the plurality of second apertures being positioned along a length of the second shaft in a spaced-apart, offset relation, wherein for each one of the combustion chambers, the second shaft is rotatable between a first orientation wherein the second shaft blocks fluid communication between the combustion chamber and the respective exhaust port and a second orientation wherein the second shaft permits fluid communication between the combustion chamber and the exhaust port through one of the second apertures.

3. The internal combustion engine according to claim 2, wherein the first and second shafts are connected to the crankshaft such that rotation of the crankshaft causes the first and second shafts to rotate.

4. The internal combustion engine according to claim 3, wherein the first and second shafts rotate at a four-to-one ratio relative to the crankshaft.

* * * * *